US005482190A

United States Patent [19]

Stanek et al.

[11] Patent Number: 5,482,190

[45] Date of Patent: Jan. 9, 1996

[54] FILLING TROUGH/DISPENSING CAP

[75] Inventors: Terrence L. Stanek, St. Louis; Stephen L. Rhea, St. Charles, both of Mo.

[73] Assignee: Emerson Electric Co., St. Louis, Mo.

[21] Appl. No.: 312,549

[22] Filed: Sep. 26, 1994

[51] Int. Cl.[6] ..... B65D 25/44

[52] U.S. Cl. ..... 222/501; 222/509; 222/518; 222/525; 222/538; 222/559; 220/86.1; 261/72.1; 261/104

[58] Field of Search ..... 222/501, 509, 222/518, 522, 525, 529, 530, 531, 538, 559, 568; 261/72.1, 104; 141/351; 220/86.1

[56] References Cited

U.S. PATENT DOCUMENTS

| | | | |
|---|---|---|---|
| 2,574,990 | 11/1951 | Waite | 222/522 |
| 2,808,178 | 10/1957 | DiGrodo et al. | 222/518 X |
| 3,206,075 | 9/1965 | Scholle | 222/518 X |
| 3,252,634 | 5/1966 | Scholle | 222/518 X |
| 3,262,613 | 7/1966 | Miller | 222/522 |
| 3,831,824 | 8/1974 | Coppersmith | 222/525 |
| 4,111,340 | 9/1978 | Greenhow et al. | 222/527 |
| 4,372,467 | 2/1983 | Pritchitt | 222/518 X |
| 4,440,316 | 4/1984 | Christine | 222/518 X |
| 4,664,547 | 5/1987 | Rosenwinkel | 401/175 |
| 4,830,226 | 5/1989 | Kong | 222/205 |
| 5,037,583 | 8/1991 | Hand | 261/26 |
| 5,154,212 | 10/1992 | Weber | 222/501 X |
| 5,250,232 | 10/1993 | Pepper et al. | 261/24 |

*Primary Examiner*—Andres Kashnikow
*Assistant Examiner*—Joseph A. Kaufman
*Attorney, Agent, or Firm*—Polster, Lieder, Woodruff & Lucchesi

[57] ABSTRACT

A filling trough/dispensing cap for a filling/dispensing opening at a lower end of an elongated liquid container is disclosed. The filling trough/dispensing cap includes a retractable/extensible liquid filling trough that extends through the filling/dispensing opening of the container and is movable to a retracted position with the container or an extensible position outside the container. When moved to the extensible position, the retractable/extensible liquid filling trough facilitates filling of the container. The retractable/extensible filling trough can be rotated and/or angularly positioned relative to the container to facilitate filling. A dispensing cap is associated with the outer end of the retractable/extensible liquid filling trough for covering the filling/dispensing opening when the retractable/extensible trough is retracted. This dispensing cap includes a selective liquid dispenser for dispensing liquid from the container, as desired.

21 Claims, 6 Drawing Sheets

FILLING TROUGH/DISPENSING CAP

BACKGROUND OF THE INVENTION

The present invention is directed to a troughcap for use with containers, and more particularly to a combined filling trough/dispensing cap primarily though not exclusively constructed for use with a removable bottle or water reservoir tank to facilitate filling and dispensing of the liquid contents of the container or tank.

Console or floor type humidifiers are constructed to be filled by one of several different methods. These different methods include: humidifiers which are mounted on casters for movement of the entire humidifier to a water source; humidifiers which include a refillable water compartment requiring the carrying of separate containers or buckets of water to refill the compartment or humidifiers which include a detachably mounted refillable bottle or container that can be carried to a water source for refilling and then resumed to the humidifier. Since some console humidifier designs include casters for moving the entire humidifier as well as a refillable water compartment, the user has the option of using either of the refilling methods in such instances. Of course, rolling the entire humidifier to a water source is burdensome and in many cases, impractical. It is also time consuming and inefficient to make repeated trips to a water source for refilling a humidifier with separate containers or buckets. In recent years, both of the aforementioned water refilling methods or techniques have generally been replaced by detachable refillable containers or bottles that are used in console or floor mounted humidifiers. Such detachable refillable containers or bottles are also used in some table top humidifier products as well.

Most of such standard detachable refillable containers or bottles include filling and dispensing caps that are located along a bottom surface of the container or bottle since water is typically gravity fed through the filling/dispensing cap into a reservoir at the bottom of the humidifier. When the filling/dispensing cap is removed, it exposes a fill opening at the bottom of the bottle. Because the fill opening typically falls at the bottom or lower end of the longest dimension of the detachable refillable container or bottle, it is most difficult to position the container or bottle under a standard faucet for filling. As a result, additional filling equipment is generally required. Such additional equipment includes a hose, bucket, pitcher or any other supplemental filling equipment.

For some period of time, there has been a need for a filling/dispensing device which avoids the current necessity of using additional filling equipment. As will be understood from the discussion that follows, the combined filling trough/dispensing cap of the present invention provides a practical and efficient way of filling a detachable refillable container or bottle while overcoming the aforementioned problems associated with prior art filling techniques.

SUMMARY OF THE INVENTION

Among the several objects and advantages of the present invention include:

The provision of a new and improved combined filling trough/dispensing cap which facilitates the filling of containers;

The provision of the aforementioned combined filling trough/dispensing cap which eliminates the necessity for additional filling equipment;

The provision of the aforementioned combined filling trough/dispensing cap which allows a user to extend the filling trough as the dispensing cap is removed from the container to facilitate filling of the container and subsequent return of the trough within the container and attachment of the dispensing cap to the container;

The provision of the aforementioned combined filling trough/dispensing cap which is capable of rotating and tilting to enable the filling trough to be easily positioned under a standard water faucet for filling;

The provision of the aforementioned combined filling trough/dispensing cap which incorporates a selective dispensing mechanism in the dispensing cap for dispensing predetermined quantities of liquid from the container, as desired; and The provision of the aforementioned combined filling trough/dispensing cap which is simple in construction, easy to manufacture by well known techniques, is durable and longlasting, is capable of being used with a variety of different bottle configurations for a variety of different uses; and is otherwise well adapted for the purposes intended.

Briefly stated, the filling trough/dispensing cap of the present invention is constructed for a filling/dispensing opening at a lower end of a container for holding liquids. It includes a retractable/extensible liquid filling trough that extends through the filling/dispensing opening and is movable to a retracted position within the container or an extensible position outside the container. The retractable/extensible liquid filling trough has an inner end and an outer end. A dispensing cap is associated with the other end of the retractable/extensible liquid filling trough and covers the filling/dispensing opening when the retractable/extensible trough is retracted. The dispensing cap also includes a selective liquid dispenser for dispensing liquids from the container.

The retractable/extensible trough has an elongated open channel construction which is preferably U-shaped in cross section.

The dispensing cap includes an internally threaded section for threaded engagement with a depending externally threaded spout that surrounds the dispensing/filling opening of the container. The dispensing cap also includes an eternally threaded section for complementary threaded engagement with an internally threaded area adjacent the outer end of the retractable/extensible trough.

The selective liquid dispenser or dispensing element may be constructed as a spring biased plunger valve that is activated when the plunger valve is engaged. The valve engages an outer free end of the internally threaded section, also hollow in construction, for sealing same until the spring biased plunger valve is activated, enabling water to be dispensed into a water reservoir.

The inner end of the retractable/extensible liquid filling trough includes a transversely extending shoulder which is greater than the dispensing/filling opening to prevent removal of the retractable/extensible liquid filing trough from the container when extended. Preferably, the transverse shoulder comprises a stopper/pivot mounted within the container about the inner end of the retractable/extensible trough. The stopper/pivot has a width greater than the dispensing/filling opening to prevent removal of the retractable/extensible trough from the container while enabling the retractable/extensible trough to rotate and/or tilt relative to a desired position to facilitate filling of the container. The stopper/pivot is collapsible on initial insertion of the retractable/extensible spout into the container. Longitudinally extending spaced slots in the stopper/pivot can provide the collapsible configuration. The stopper/pivot also has an exterior curvilinear shape to facilitate rotating and tilting or angular positioning of the retractable/extensible trough to the container.

These and other objects and advantages of the present invention will become more apparent from the description that follows.

BRIEF DESCRIPTION OF THE DRAWINGS

Corresponding reference numerals will be used throughout the several figures of the drawings.

DESCRIPTION OF THE PREFERRED EMBODIMENTS

The following detailed description illustrates the invention by way of example and not by way of limitation. This description will clearly enable one skilled in the art to make and use the invention, and describes several embodiments, adaptions, variations, alternatives and uses of the filling trough/dispensing cap of the present invention, including what we presently believe is the best mode of carrying out the invention.

Figure 1:
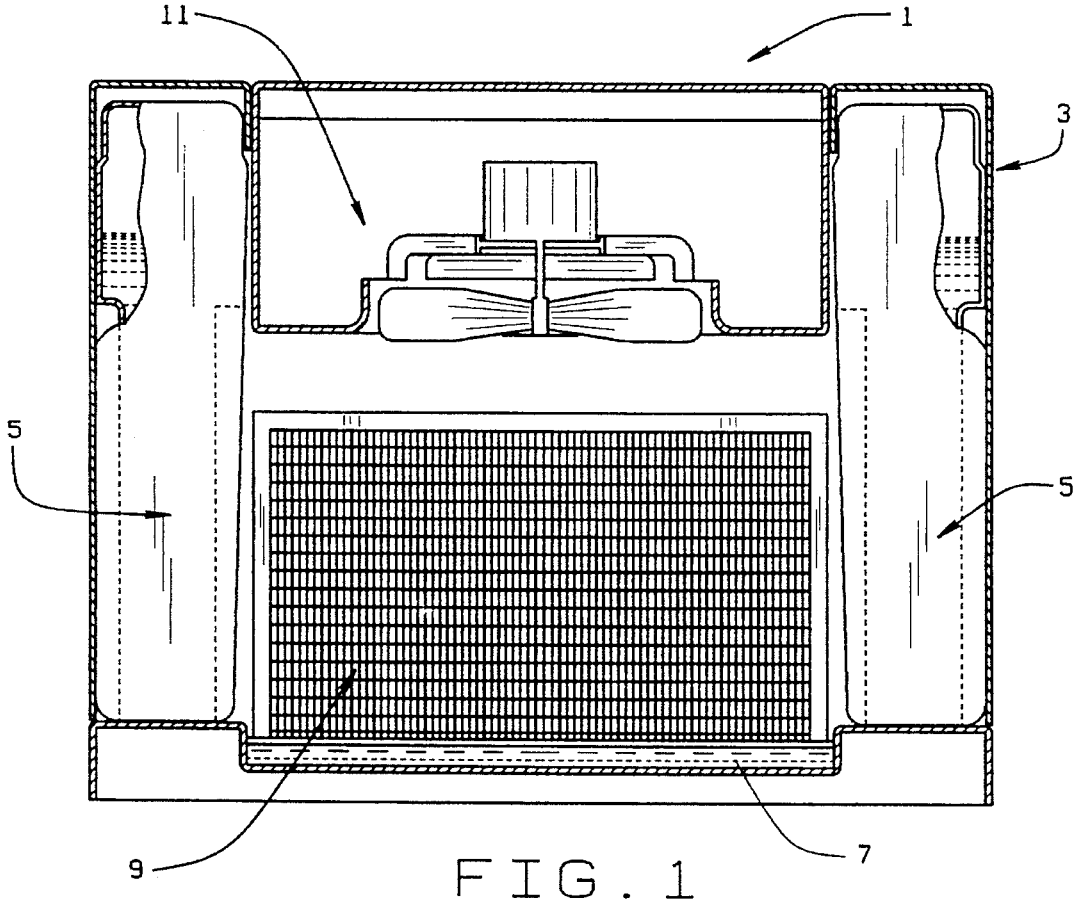
FIG. 1 is a front elevational view of a typical floor mounted or console humidifier which incorporates a pair of spaced liquid dispensing bottles or containers.

The console or floor mounted humidifier 1 illustrated in FIG. 1 of the drawings includes a cabinet 3 having a generally rectangular configuration for receiving the spaced water bottles 5, 5 on opposite sides thereof for dispensing water into a water reservoir 7 formed in the bottom wall of the humidifier cabinet 3. A wicking element 9 is supported within the cabinet 3 and includes a lower end that is positioned within the water reservoir 7 to enable water to be transferred by capillary action upwardly into the wicking element 9 for saturating same. An electric fan 11 is supported at an upper end of the cabinet 3 for blowing air through the wicking element 9 in order to transfer water to the atmosphere. The arrangement and construction of the above described elements are well known in the art and form no part per se of the present invention; however, they do show the environment in which the present invention is utilized.

As indicated above, one of the preferred methods of dispensing water into the humidifier is through bottles 5 which include selective dispensing elements for dispensing water from the bottles 5 when the water in the water reservoir 7 falls below a predetermined level. The construction of the selective dispensing element will be further described below in conjunction with the filling trough/dispensing cap of the present invention.

Figure 2:
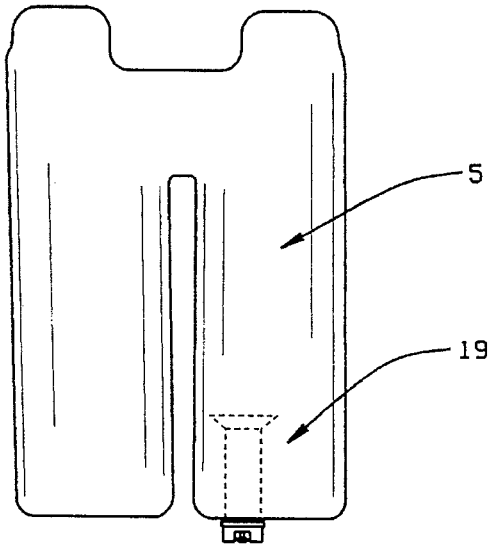
FIG. 2 is a side elevational view of one of the liquid bottles or container which incorporates the filling trough/dispensing cap of the present invention, shown partly in full and partly in hidden lines.

When using water bottles or containers 5 such as illustrated in FIGS. 1–2 of the drawings, there is a problem in filling the containers due to the necessity of gravity feeding water from the bottles into the humidifier. In the typical humidifier water bottle or container, the filling/dispensing opening is located along the bottom wall or surface of the bottle or container. In order to contain a sufficient amount of water within the humidifier bottle or container, it must have an elongated height or length as shown in FIG. 2 of the drawings. This means that the filling/dispensing opening will typically be located at the lower end of the longest dimension of the bottle or container 5. As will be appreciated, this makes it difficult, if not impossible, to position the refillable humidifier bottle or container under a standard water faucet for filling purposes. As a result, additional filling equipment has been required including the use of a hose, bucket, pitcher, etc. For reasons which will become apparent in the discussion that follows, such additional filling equipment is not only impractical, it is no longer required due to the filling trough/dispensing cap of the present invention.

It will also be apparent that the filling trough/dispensing cap of the present invention could be used with a variety of different bottles and containers in humidifiers and other products as may be desired.

There are two different embodiments of the filing trough/dispensing cap of the present invention disclosed in the drawings: the embodiment illustrated in FIGS. 3–6 and the embodiment illustrated in FIGS. 7–12. Quite clearly, designs other than those illustrated in the drawings come within the purview of the present invention.

Figure 3:
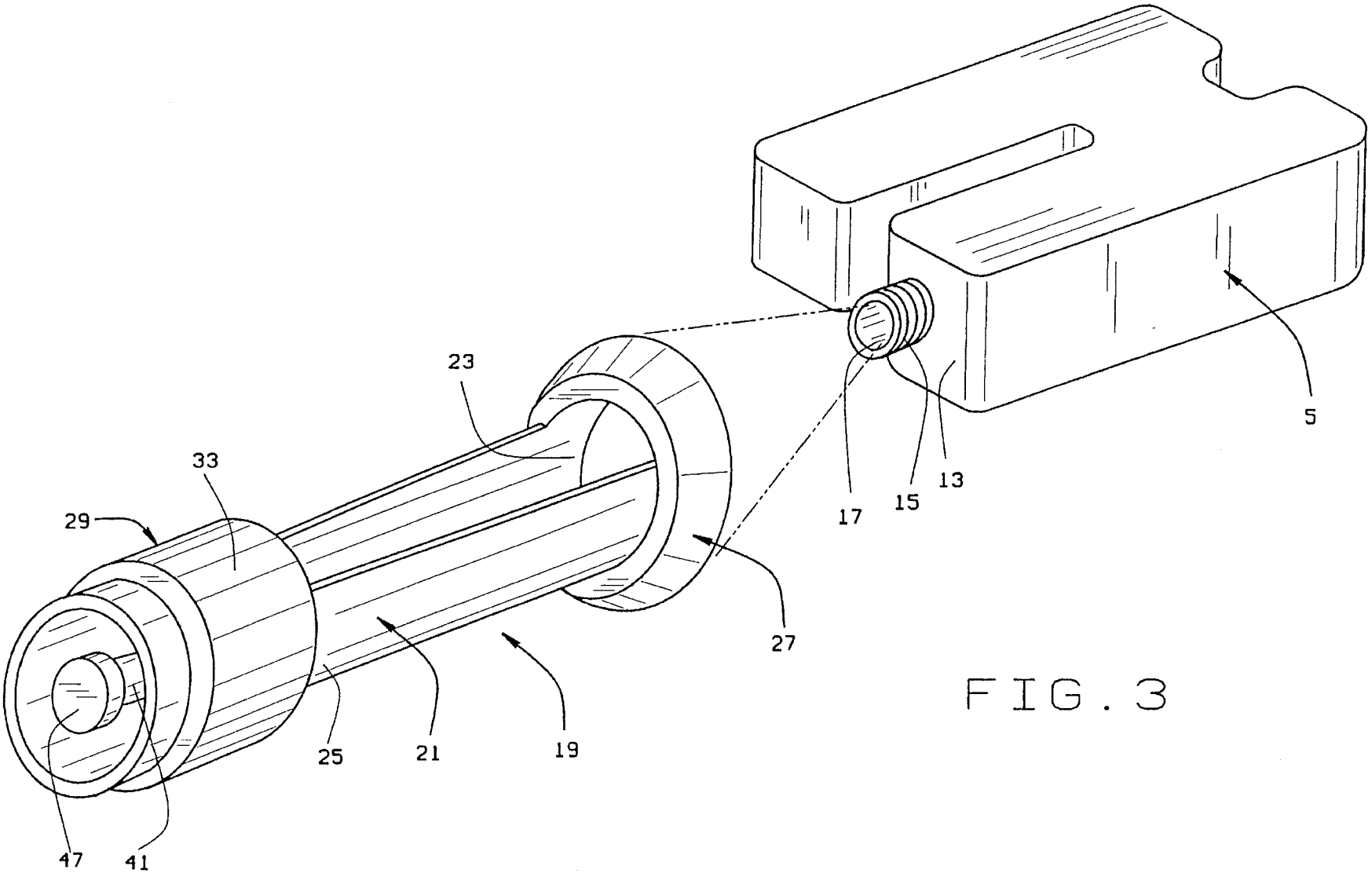
FIG. 3 is an enlarged exploded perspective view of one disclosed embodiment of the filling trough/dispensing cap of the present invention.
Figure 4:
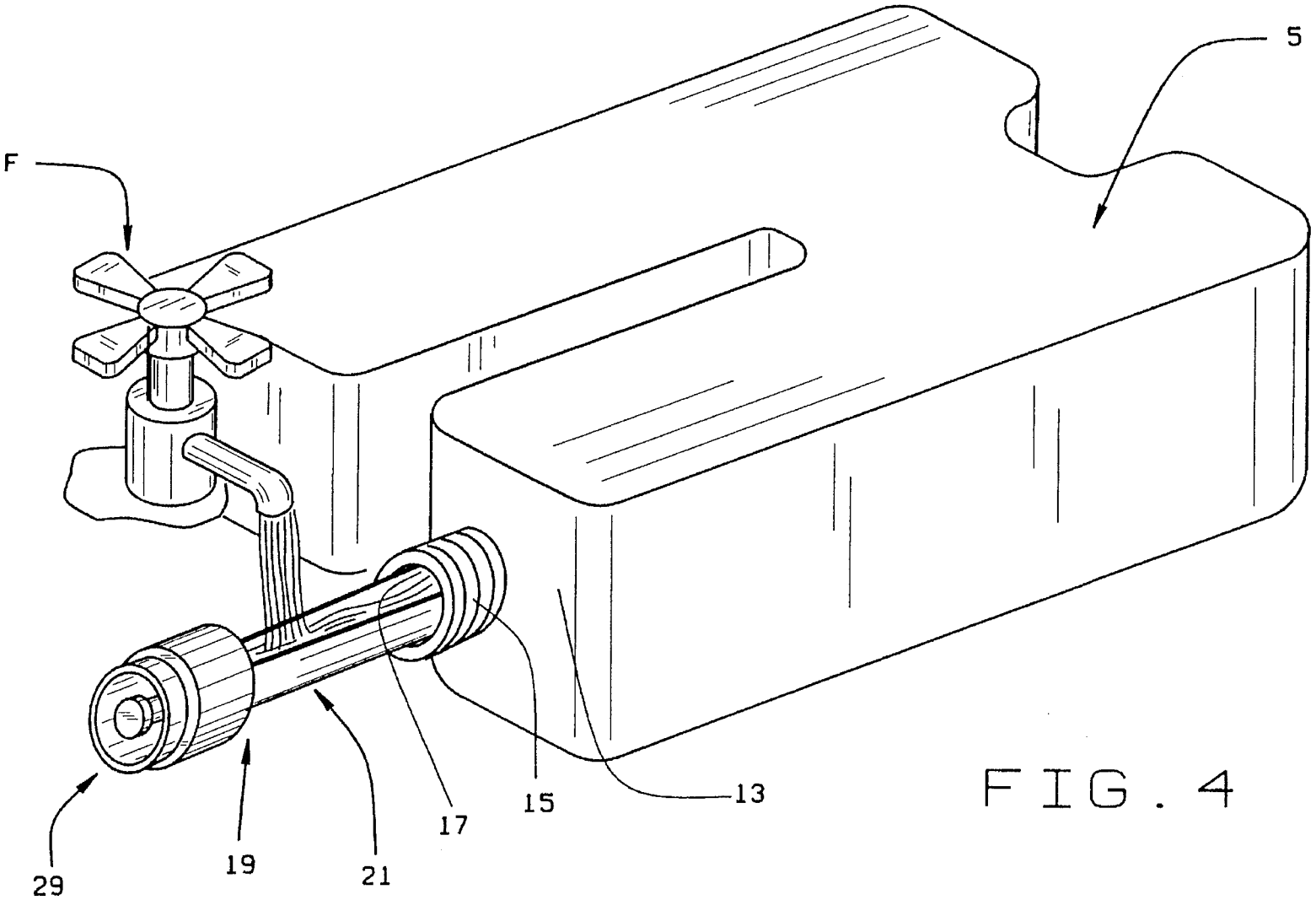
FIG. 4 is an enlarged perspective view illustrating the manner in which the filling trough/dispensing cap of FIG. 3 is retracted from the container to facilitate filling of the container through the filling trough/dispensing cap of the present invention.

Reference is first made to the embodiment illustrated in FIGS. 3–6. As shown in FIG. 3 of the drawings, the lower end or bottom wall 13 of the container 5 includes a hollow eternally threaded spout 15 which projects downwardly from the lower end or bottom wall 13 of the bottle or container 5 and defines a filling/dispensing opening 17 through which the container 5 is filled with water and from which water is dispensed.

According to the present invention, the filling trough/dispensing cap 19 is constructed for use with and mounting relative to the eternally threaded spout 15 and filling/dispensing opening 17 of the container 5. The filling trough/dispensing cap 19 includes a retractable/extensible liquid filling trough 21 having an elongated open channel construction that is generally U-shaped in cross section. The retractable/extensible liquid filling trough 21 extends through the filling/dispensing opening 17 and is movable to a retracted position within the container or bottle 5 or an extensible position outside the container or bottle 5. The retractable/extensible liquid filling trough 21 includes an inner end 23 and an outer end 25. A stopper/pivot 27 is mounted within the container about the inner end 23 of the retractable/extensible trough 21. The stopper/pivot 27 has a width greater than the dispensing/filling opening 17 to prevent removal of the retractable/extensible filling trough 21 when extended from the bottle or container 5. The stopper/pivot 27 is secured to the inner end 23 of the filling trough 21 in any convenient manner such as by an adhesive or bonding. However, the stopper/pivot 27 enables the filling trough 21 to be adjustably rotated to any desired position in order to facilitate filling of the bottle or container 5. This is illustrated, for example, in FIG. 4 of the drawings where a standard faucet F is utilized to fill the bottle or container 5. It will be noted that the bottle or container 5 is positioned with the bottom wall 13 extending adjacent the faucet F in order to permit the filling trough 21 to be rotated to the desired position for receiving water from the faucet F for filling the bottle or container 5. It will be appreciated that the bottle or container 5 is made from a material that enables a user to readily see when the bottle or container 5 is filled. Thus, when the bottle or container 5 is filled, the faucet F will be shut off and the filling trough 21 re-inserted within the bottle or container 5.

Figure 5:
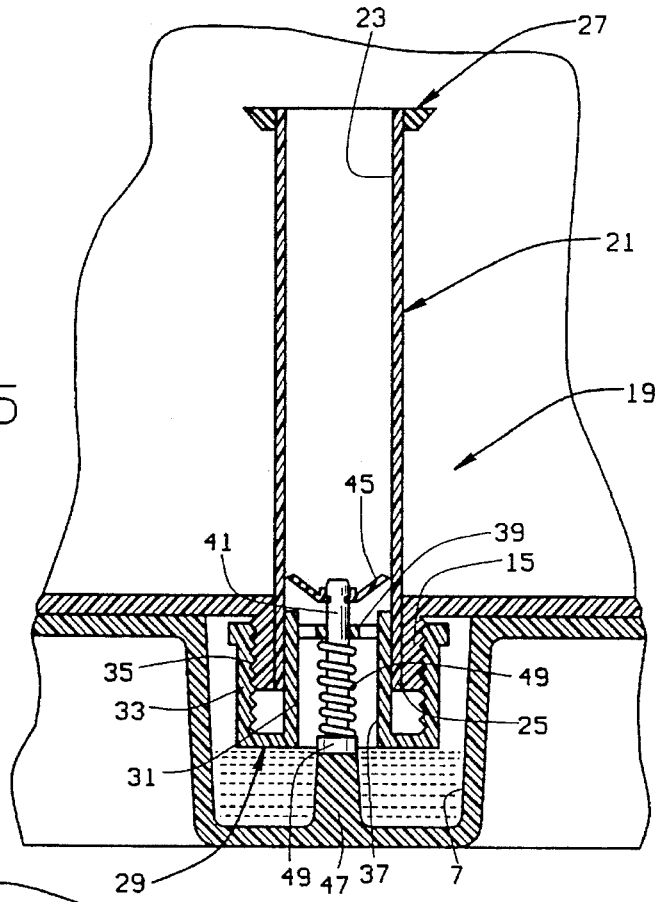
FIG. 5 is an enlarged sectional view illustrating the manner in which the filling trough/dispensing cap of FIGS. 3–4 is mounted relative to the bottle or container when in retracted position.
Figure 6:
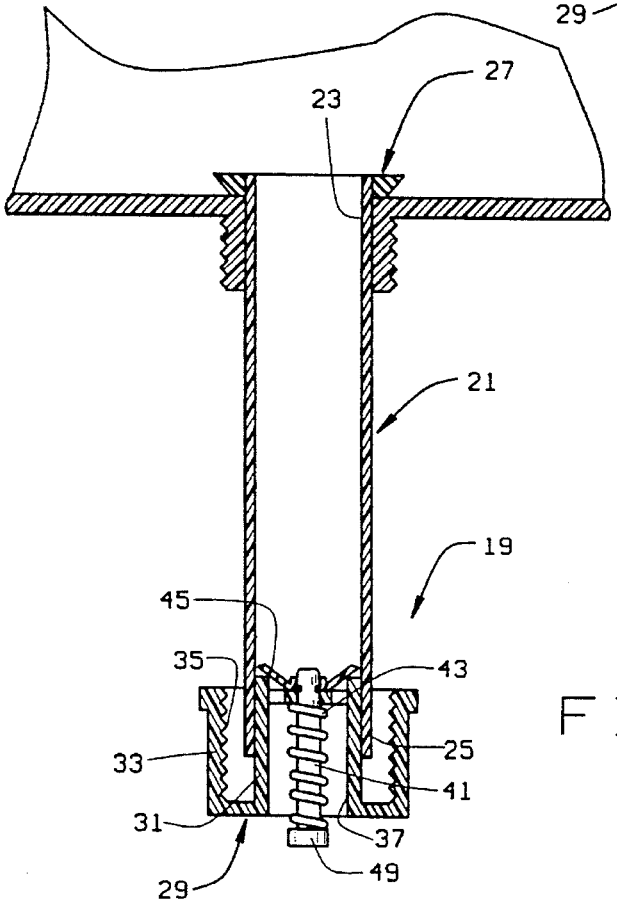
FIG. 6 is an enlarged sectional view of the filling trough/dispensing cap of FIGS. 3–4 when extended from the bottle or container.

In order to secure the retractable/extensible filling trough 21 within the bottle or container 5, the outer end 25 of the filling trough 21 is attached or otherwise associated to the dispensing cap 29 along an inner surface of the filling trough 21 at its outer end 25. Specifically, a circumferentially extending inner section 31 is adhesively secured or bonded to the outer end 25 of the filling trough 21 along an inner wall surface thereof, as best seen in FIGS. 5–6 of the drawings. An outer circumferential section 33 is internally threaded at 35 for complementary threaded mating engagement with the externally threaded spout 15 of the bottle or container 5. Thus, when the filling trough 21 is re-inserted back within the bottle or container 5, the dispensing cap 29 suitably secures and holds the filling trough 21 within the bottle or container 5 through the complementary threaded mating engagement between the outer circumferential section 33 and its internally threaded portion 35 with the eternally threaded spout 15 of the bottle or container 5.

The inner circumferential section 31 includes a downwardly extending internal opening 37 and an upper transverse wall 39. A plunger valve 41 is received within the downwardly extending opening 37 and supported by the upper segmented transverse wall 39 of the inner circumferential section 31. The plunger valve 41 is normally spring biased into a closed or sealed position by a coil spring 43 that engages a lower surface of the upper segmented transverse wall 39 of the inner circumferential section 31. A frustoconically shaped sealing member 45 is mounted to the plunger valve 41 above the upper segmented transverse wall 39 to prevent any water from passing by the upper segmented transverse wall 39 when the plunger valve 41 is in a normally closed position.

As best seen in FIG. 5 of the drawings, the dispensing cap 29 is arranged to be received within a portion of the reservoir 7 that includes an upstanding abutment 47 for engaging a lower end 49 of the plunger 41 in order to move the sealing member 45 of the plunger valve 41 upwardly against the force of the coil spring 43. Without the upstanding abutment 47 engaging the lower end 49 of the plunger valve 41, the force of the water within the bottle or container 5 will push the sealing member 45 downwardly against the coil spring 43 to cause the sealing member 45 to seal off the upper transverse segmented wall 39 in sealed engagement. However, when the plunger valve 41 is moved upwardly to the position illustrated in FIG. 5 of the drawings, water within the bottle or container 5 will be dispensed through the upper transverse segmented wall 39 into the reservoir 7. It will be apparent that other types of plunger valve constructions may be utilized with the dispensing cap 29 in order to achieve the same desired result.

Reference is now made to FIGS. 7–12 for a description of the second illustrated embodiment of the present invention.

The filling trough/dispensing cap 51 of the FIGS. 7–12 embodiment functions generally in the same manner as the filling trough/dispensing cap 19 of the FIGS. 3–6 embodiment with the differences explained below. The filling trough/dispensing cap 51 includes a retractable/extensible liquid filling trough 53 having an elongated open channel U-shaped in cross section construction with an inner end 55 and an outer end 57. Integrally joined to the retractable/extensible liquid filling trough 53 at its inner end 55 is a stopper/pivot 59 having a partial spherical shape with spaced generally aligned longitudinal slots 61, 61. At the outer end 57 of the retractable/extensible liquid filing trough 53, a separately mounted dispensing cap 63 is mounted.

Figure 7:
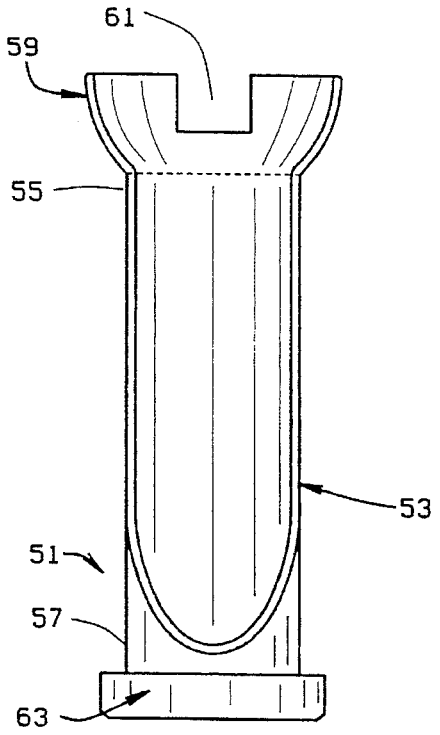
FIG. 7 is an enlarged top plan view of another form of filling trough/dispensing cap coming within the purview of the present invention.
Figure 8:
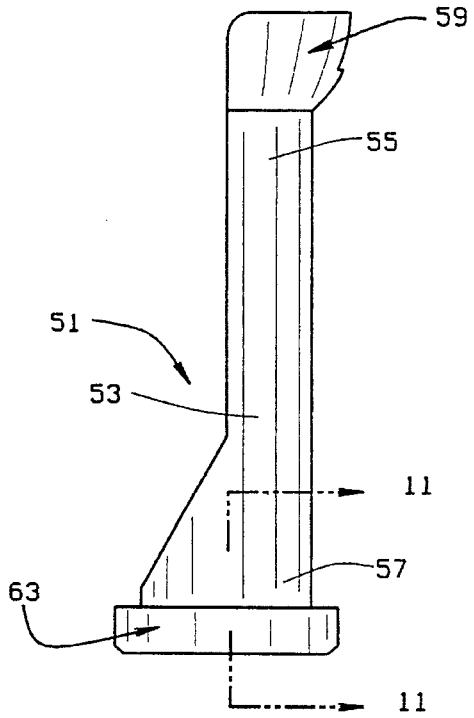
FIG. 8 is an enlarged side elevational view of the filling trough/dispensing cap embodiment shown in FIG. 7.

All of the above described elements in the FIGS. 7–12 embodiment function in the same manner as in the FIGS. 3–6 embodiment, except as now described. First of all, the retractable/extensible liquid filling trough 53 differs in configuration than the retractable/extensible liquid filling trough 21 in that, as seen in the top and side elevational views of FIGS. 7–8 of the drawings, the retractable/extensible liquid filling trough 21 tapers upwardly towards the dispensing cap 63, as shown in FIG. 8, and includes a curvilinear opening closing off the U-shaped open channel construction at the inner end 57, as shown in FIG. 7. This construction is utilized in providing a circumferentially extending wall area for use with the dispensing cap 63, as discussed further below.

With respect to the stopper/pivot 59, the spaced longitudinally extending slots 61, 61 enable the stopper/pivot 59 to be inserted into the threaded spout 15 of the container 5 during the initial assembly of the filling trough/dispensing cap 51 to the container 5. Once inside the container 5, the stopper/pivot 59 will flex outwardly to a width greater than the filling/dispensing opening 17 to prevent inadvertent withdrawal/removal of the filling trough/dispensing cap 51 relative to the bottle or container 5.

Figure 9:
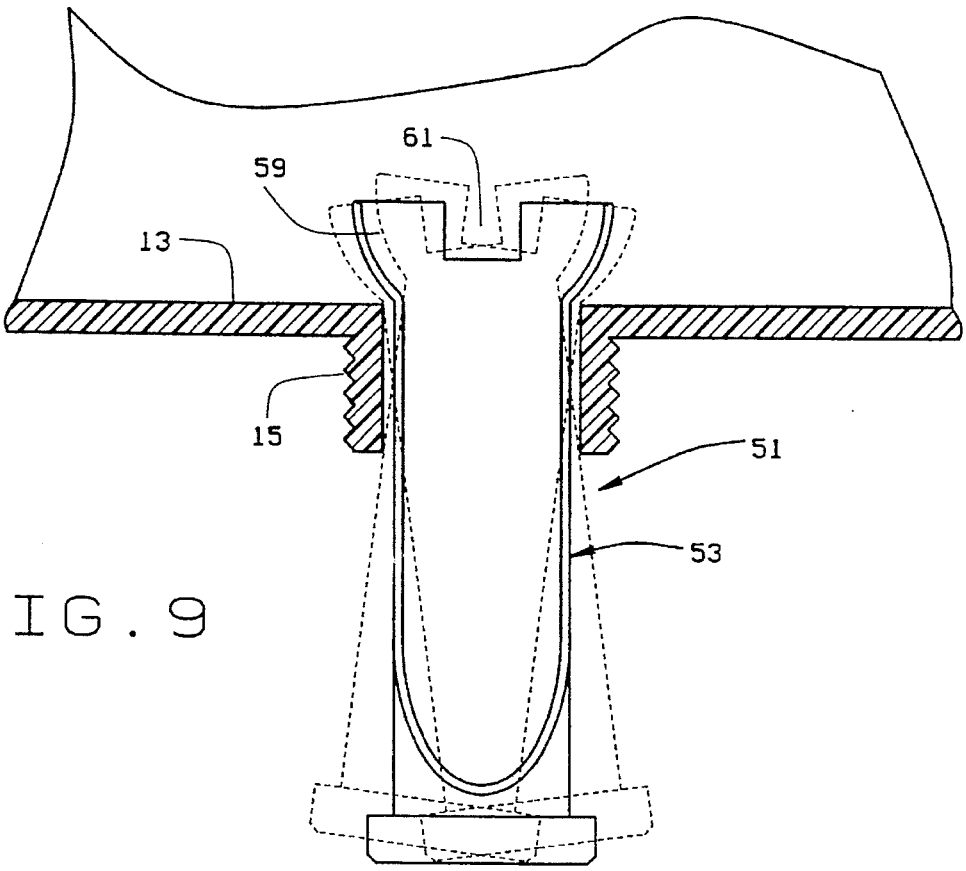
FIG. 9 is an enlarged fragmentary elevational view, partly in section, illustrating how the stopper/pivot construction of the FIGS. 7–8 embodiment is rotated and inclined relative to one type of liquid dispensing bottle construction.
Figure 10:
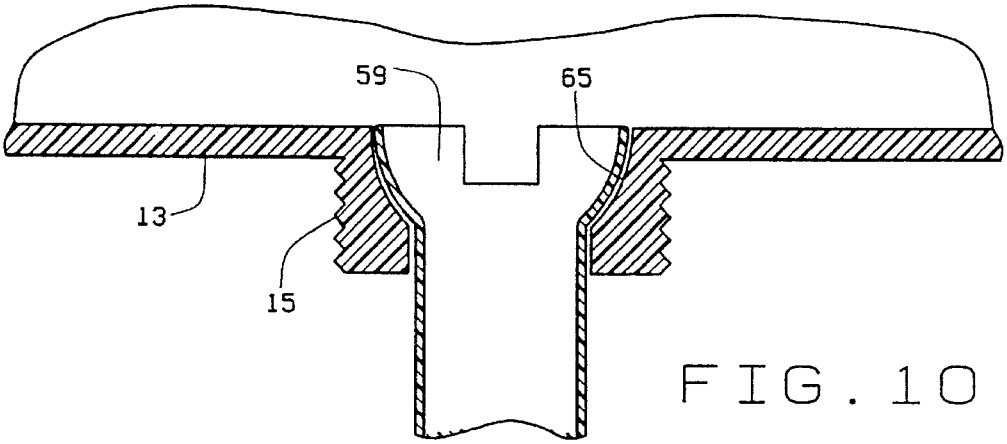
FIG. 10 is an enlarged fragmentary elevational view, partly in section, illustrating how the stopper/pivot construction of the FIGS. 7–8 embodiment is positioned in a modified liquid dispensing bottle construction.

The outer generally curvilinear or partial spherical shape of the stopper/pivot 59 enables the filling trough/dispensing cap 19 to be rotated or tilted relative to the opening 17, in order to position same relative to a water faucet F for filling the container 5. As will be appreciated, the curvilinear or partial spherical shape of the stopper/pivot 59 facilitates the rotation or tilting of the filling trough/dispensing cap 51 relative to the bottle or container 5 somewhat better than the stopper/pivot 27 in the FIGS. 3–6 embodiment. This can be best understood by referring to FIGS. 9–10 of the drawings where FIG. 9 illustrates full line and phantom positions of the filling trough/dispensing cap 51 relative to the bottle or container 5. In FIG. 10 of the drawings, a modified container 5 includes a generally spherical shaped section 65 between the bottle 5 and the dispensing spout 15. This generally spherically shaped section 65 is constructed to permit the complementary shaped stopper/pivot 59 to be received in the bottle section 65. Preferably, the generally spherically shaped bottle section 65 is dimensioned to tightly grip or somewhat constrict the stopper/pivot 59 in order to provide the desired rotating and tilting action while making removal of the filling trough/dispensing cap 51 more difficult to achieve.

The dispensing cap 63 at the outer end 57 of the retractable/extensible liquid filling trough 53 includes axially spaced external and internally threaded sections 67, 69 respectively. The externally threaded section 67 has a smaller diameter than the externally threaded section 69 for receipt within the outer end 57 of the retractable/extensible liquid filling trough 53. Complementary mating threads 71 are provided along the inner wall area of the outer end 57 in order to threadably interconnect the dispensing cap 67 relative to the retractable/extensible liquid filling trough 53. The internally threaded section 69 of the dispensing cap 63 cooperates with the externally threaded spout 15 in complementary threaded mating engagement in order to mount the dispensing cap 63 with the retractable/extensible liquid filling trough 53 to the bottle or container 5 in the same manner as the FIGS. 3–6 embodiment.

Figure 11:
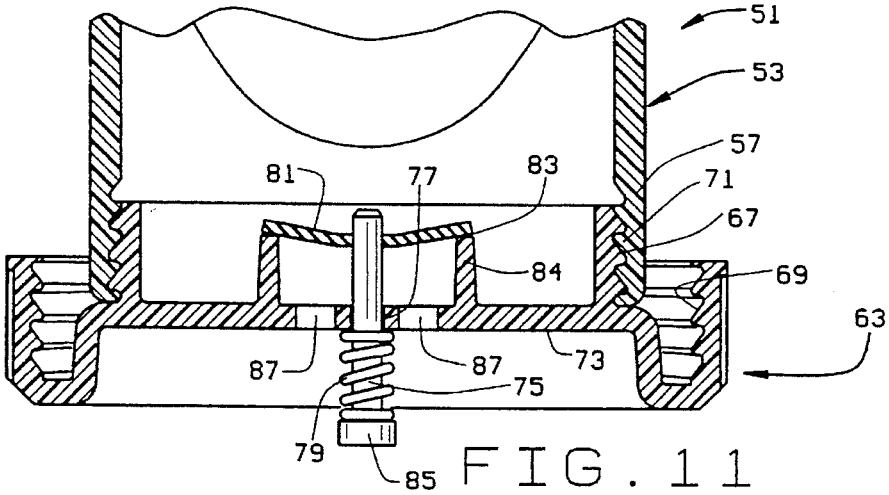
FIG. 11 is an enlarged fragmentary sectional view illustrating the manner in which the FIGS. 7–8 filling trough/dispensing cap is mounted relative to a liquid dispensing bottle or container when in retracted position.

The dispensing cap 63 includes an integrally connected end wall 73 which connects the externally threaded section 67 to the externally threaded section 69, as best seen in FIGS. 10–11 of the drawings. A plunger valve 75 is received within an opening 77 in the end wall 73 of the dispensing cap 63. The plunger valve 75 is normally spring biased into a closed or sealed position by a coil spring 79 that draws a frusto-conically shaped sealing or flapper valve member 81 into sealing contact with an outer free end 83 of an integral centrally positioned tubular extension 84.

Figure 12:
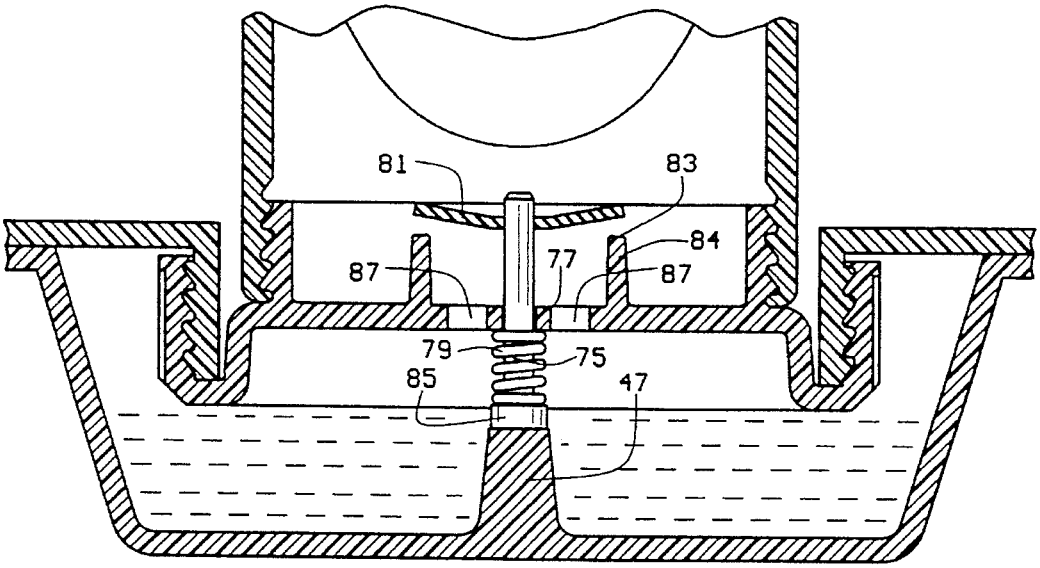
FIG. 12 is an enlarged fragmentary sectional view of the FIGS. 7–8 filling trough/dispensing cap when extended from a dispensing bottle or container.

As shown in FIG. 12 of the drawings, the dispensing cap 63 is arranged to be received within the portion of the reservoir 7 that includes an upstanding abutment 47 for engaging the lower end 85 of the plunger 75 in order to move the sealing member 81 upwardly against the force of the coil spring 79. Without the upstanding abutment 47 engaging the lower end 85 of the plunger valve 75, the force of the water within the bottle or container 5 will push the sealing member 81 downwardly against the coil spring 79 to cause the sealing member 81 to seal off the hollow tubular extension 84 at its outer free end 83. However, when the plunger valve 75 is moved upwardly to the position shown in FIG. 12 of the drawings, water within the bottle or container 5 will be dispensed through openings 87 in the end wall 73 and into the reservoir 7.

It will thus be seen that the FIGS. 7–12 embodiment functions generally in the same manner as the FIGS. 3–6 embodiment, except as noted above.

From the foregoing, it will now be appreciated that the filling trough/dispensing cap of the present invention provides an effective way to fill bottles from the bottom end, such as is required with most humidifier bottles or containers. By simply extending the retractable/extensible liquid filling trough from the bottle or container and rotating same to a desired position for receiving water from a standard faucet, the bottle or container can be easily filled. A stopper/pivot mounted to an inner end of the retractable/extensible trough prevents removal of the retractable/extensible trough from the bottle or container when extended while also enabling the retractable/extensible trough to rotate to a desired position to facilitate filling of the container. Following filling of the bottle or container, a dispensing cap that is mounted to the outer end of the retractable/extensible trough suitably covers the dispensing/filling opening of the bottle or container. This is typically achieved by complementary threaded engagement between the dispensing cap and an externally threaded spout that surrounds the dispensing/filling opening of the bottle or container. The dispensing cap also includes a selective liquid dispensing element, typically in the form of a plunger valve or the like, for dispensing predetermined quantities of liquid from the bottle or container when actuated.

In view of the above, it will be seen that the several objects and features of this invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

We claim:

1. A trough/cap for a filling/dispensing opening at a lower end of a container for holding liquids, comprising:

a retractable/extensible liquid filling trough that extends through the filling/dispensing opening of the container and is movable to a retracted position within the container or an extensible position outside the container, said retractable/extensible liquid filling trough having an inner end and an outer end; and a dispensing cap associated with the outer end of the retractable/extensible liquid filling trough which covers the filling/dispensing opening when the retractable/extensible trough is retracted within the container, said dispensing cap includes a liquid dispenser for dispensing liquid from the container.

2. A trough/cap as defined in claim 1 wherein the dispensing cap is mounted to the outer end of the retractable/extensible trough.

3. The trough/cap as defined in claim 1 wherein the retractable/extensible trough has an elongated open channel construction.

4. The trough/cap as defined in claim 3 wherein the retractable/extensible trough has a U-shaped configuration in cross section.

5. The trough/cap as defined in claim 1 wherein the cap includes an internally threaded section for threaded engagement with a depending externally threaded spout of the container that surrounds the dispensing/filling opening.

6. The trough/cap as defined in claim 1 wherein the liquid dispensing element is a spring biased plunger valve that is activated when the plunger valve is engaged.

7. The trough/cap as defined in claim 1 and further including a transversely extending shoulder at the inner end of the trough/cap which is greater than the dispensing/filling opening to prevent removal of the retractable/extensible trough from the container when extended.

8. The trough/cap as defined in claim 1 and further including a stopper/pivot mounted within the container about the inner end of the retractable/extensible trough, said stopper/pivot having a width greater than the filling/dispensing opening to prevent removal of the retractable/extensible trough from the container while enabling the retractable/extensible trough to rotate to a desired position to facilitate filling of the container.

9. The trough/cap as defined in claim 8 wherein the stopper/pivot is collapsible upon the insertion of the retractable/extensible trough into a depending spout that surrounds the dispensing/filling opening of the container.

10. A filling trough/dispensing cap for a filling/dispensing opening at a lower end of a container for liquids, the trough/cap including:

a retractable/extensible trough that extends through the filling/dispensing opening and into the container when retracted and being at least partially extensible from the container when extended, said retractable/extensible trough having an inner end and an outer end, the outer end of said retractable/extensible trough extending outside the container when extended;

a dispensing cap mounted to the outer end of the retractable/extensible trough for covering the filling/dispensing opening of the container when the retractable/extensible trough is retracted, said dispensing cap including a selective liquid dispensing element for dispensing predetermined quantities of liquid from the container when actuated; and a stopper/pivot mounted within the container about the inner end of the retractable/extensible trough, said stopper/pivot having a width greater than the filling/dispensing opening to prevent removal of the retractable/extensible trough from the container while also enabling the retractable/extensible trough to rotate to a desired position to facilitate filling of the container.

11. The trough/fill cap as defined in claim 10 wherein the retractable/extensible trough has a U-shaped cross sectional configuration.

12. The trough/fill cap as defined in claim 10 wherein the selective liquid dispensing element is a spring biased plunger valve that is activated when the plunger valve is engaged.

13. The trough/fill cap as defined in claim 10 wherein the dispensing cap includes an internally threaded section for threaded engagement with an externally threaded spout that surrounds the filling/dispensing opening of the container.

14. The trough/fill cap as defined in claim 10 wherein the stopper/pivot is collapsible upon the initial insertion of the retractable/extensible trough into the externally threaded spout of the container.

15. The trough/fill cap as defined in claim 14 wherein the stopper/pivot has spaced longitudinal extending slots to facilitate collapse of the stopper/pivot upon initial insertion into the externally threaded spout of the container.

16. A filling trough/dispensing cap for a filling/dispensing opening at a lower end of a container for liquids, the trough/cap including:

a retractable/extensible trough that extends through the filling/dispensing opening and into the container when retracted and being at least partially extensible from the container when extended, said retractable/extensible trough having an inner end and an outer end, the outer end of said retractable/extensible trough extending outside the container when extended;

a dispensing cap threadably mounted to the outer end of the retractable/extensible trough and also being threadably mounted to a spout surrounding the filling/dispensing opening of the container for covering the filling/dispensing opening of the container when the retractable/extensible trough is in either retracted or extensible position, said dispensing cap including a selective liquid dispensing element for dispensing predetermined quantities of liquid from the container when actuated; and a stopper/pivot mounted within the container about the inner end of the retractable/extensible trough, said stopper/pivot having a width greater than the filling/dispensing opening to prevent removal of the retractable/extensible trough from the container while also enabling the retractable/extensible trough to rotate to a desired position to facilitate filling of the container, said stopper/pivot being collapsible upon initial insertion into the externally threaded spout of the container.

17. The filling trough/dispensing cap as defined in claim 1 wherein the dispensing cap has an externally threaded section for complementary threaded engagement with an internally threaded area adjacent the outer end of the retractable/extensible trough, said dispensing cap also having an internally threaded section for complementary threaded engagement with an externally threaded area of said spout.

18. The filling trough/dispensing cap as defined in claim 17 wherein the externally threaded section of the dispensing cap is hollow and terminates at outer free end, and said selective liquid dispensing element includes a spring biased flapper valve engaging and sealing off the hollow externally threaded section at its outer free end, said spring biased flapper valve being selectively displaced from engagement with the outer free end of the hollow externally threaded section to permit water within the container to flow past the dispensing cap into a water reservoir.

19. The filling trough/dispensing cap as defined in claim 16 wherein the stopper/pivot has an external curvilinear shape to permit rotating as well as angular positioning of the retractable/extensible through relative to said container.

20. The filling trough/dispensing cap as defined in claim 19 wherein the externally curved stopper/pivot is received within a complementary shaped recess of the container to facilitate the aforementioned rotary and angular positioning.

21. The filling trough/dispensing cap as defined in claim 16 wherein the stopper/pivot has spaced longitudinally extending slots to facilitate collapse of the stopper/pivot upon initial insertion into the externally threaded spout of the container.

* * * * *

UNITED STATES PATENT AND TRADEMARK OFFICE

CERTIFICATE OF CORRECTION

PATENT NO. : 5,482,190
DATED : January 9, 1996
INVENTOR(S) : Terrence L. Stanek et al It is certified that error appears in the above-indentified patent and that said Letters Patent is hereby corrected as shown below:

Column 1, Line 19, delete "resumed" and insert --returned--.

Column 10, Line 24, delete "1" and insert --16--.

Signed and Sealed this

Sixteenth Day of July, 1996

*Attest:*

*Attesting Officer*

BRUCE LEHMAN

*Commissioner of Patents and Trademarks*